US007300382B2

(12) United States Patent
Yamamoto

(10) Patent No.: US 7,300,382 B2
(45) Date of Patent: Nov. 27, 2007

(54) ENGINE STARTING APPARATUS FOR AN ALL-TERRAIN VEHICLE

(75) Inventor: Takao Yamamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 108 days.

(21) Appl. No.: 11/167,901

(22) Filed: Jun. 27, 2005

(65) Prior Publication Data

US 2005/0288151 A1 Dec. 29, 2005

(30) Foreign Application Priority Data

Jun. 29, 2004 (JP) ..... 2004-190730

(51) Int. Cl.
*B60W 10/04* (2006.01)
*B60W 10/10* (2006.01)
*F02P 5/00* (2006.01)

(52) U.S. Cl. ..... 477/110; 123/406.11

(58) Field of Classification Search ..... 477/110.11; 123/406.11

See application file for complete search history.

(56) References Cited

U.S. PATENT DOCUMENTS 6,880,687 B2 * 4/2005 Markyvech et al. ..... 192/13 R
2002/0134606 A1 9/2002 Kawamoto et al.
2003/0087724 A1 * 5/2003 Seibertz et al. ..... 477/92
2004/0188218 A1 * 9/2004 Berger et al. ..... 192/90
2005/0023050 A1 * 2/2005 Chidlow et al. ..... 180/11

FOREIGN PATENT DOCUMENTS

| | | |
|---|---|---|
| JP | 61-167166 | 7/1986 |
| JP | 62-255572 | 11/1987 |
| JP | 05-209584 | 8/1993 |
| JP | 09-053551 | 2/1997 |

* cited by examiner

*Primary Examiner*—Tisha Lewis
(74) *Attorney, Agent, or Firm*—Carrier Blackman & Associates, P.C.; William D. Blackman; Joseph P. Carrier

(57) ABSTRACT

A starting system is operable to quickly start an engine of an all-terrain vehicle, even when a transmission gear is at a forward gear position. A CPU detects the gear position of the transmission based on a gear position control signal generated by a shift switch and a diode box. When the transmission gear is neutral or a forward gear position, the CPU enables the engine to start, according to a start command operation performed by the operator, with a crankshaft and the transmission disengaged from one another by a centrifugal clutch. When the transmission gear is in reverse, the engine is prevented from starting.

15 Claims, 9 Drawing Sheets

ENGINE STARTING APPARATUS FOR AN ALL-TERRAIN VEHICLE

CROSS-REFERENCE TO RELATED APPLICATIONS

The present invention claims priority under 35 USC 119 based on Japanese patent application No. 2004-190730, filed on Jun. 29, 2004. The subject matter of this priority document is incorporated by reference herein.

BACKGROUND OF THE INVENTION

1. Field of the Invention

The present invention relates to a starter apparatus for use in an all-terrain vehicle, which is usable to connect and disconnect a crankshaft of an engine and a transmission via a centrifugal-type clutch, and which cooperates with an ignition system to enable starting of the engine.

2. Description of the Background Art

In motor vehicles, it is well known to provide an engine command that is operable to start an engine only when the transmission is in a neutral gear. An example of this type of command is described in Japanese published Patent document JP-A-5-209584, which discloses an engine that permits starting according to an engine start command only when the engine is in a neutral gear, and that prevents starting when the engine is in a gear other than neutral.

Although the known engine starting devices have some utility for their intended purposes, a need still exists in the art for an improved starting device for an all-terrain vehicle. Since an all-terrain vehicle travels on a rough road surface, an ability to start the engine quickly is needed, for example, when the engine is stopped while it is traveling forward and situated on a steep uphill grade. In other words, it is desired that the engine can be started even when the transmission is in a forward gear position.

SUMMARY OF THE INVENTION

The present invention provides a starter apparatus for an all-terrain vehicle which enables the engine to be started quickly, even when the transmission is in a forward gear.

In order to solve the problem described above, a starter apparatus for an all-terrain vehicle, according to an illustrative embodiment of the invention, includes a centrifugal clutch, a gear position sensor, and a controller. The centrifugal clutch transmits the rotary force of a crankshaft to the transmission, when the rotary speed of the crankshaft reaches a predetermined value, so as to overcome a spring force of the centrifugal clutch. The gear position sensor detects the gear position of the transmission. The controller enables the engine to start according to the start command operation when the crankshaft and the transmission are disconnected by the centrifugal clutch, for cases when the transmission is either in neutral or in a forward gear, as detected by the gear position sensor.

In this case, the controller may be adapted to start the engine according to the start command operation when the transmission is in a forward gear, a brake is operated, and a stop switch is in the closed state.

Alternatively, the controller may prohibit the engine from starting, if the gear position sensor detects that the transmission is in reverse.

Furthermore, the gear position sensor may include a shift switch having a plurality of contact points opened and closed according to the gear position of the transmission.

The gear position sensor may also include a diode box having a plurality of diodes which are electrically connected to the contact points and, in cooperation with the shift switch, produces a gear position detection signal, in which the diode box causes a gear position detection signal to branch into an engine start control signal and a gear position display signal.

According to the present invention, even when the transmission is in a forward gear, the engine can be quickly started. Also, the gear position detection signal can be branched into the engine start control signal and the gear position display signal with a simple circuit structure, and the inverse current can be prevented.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

Figure 1:
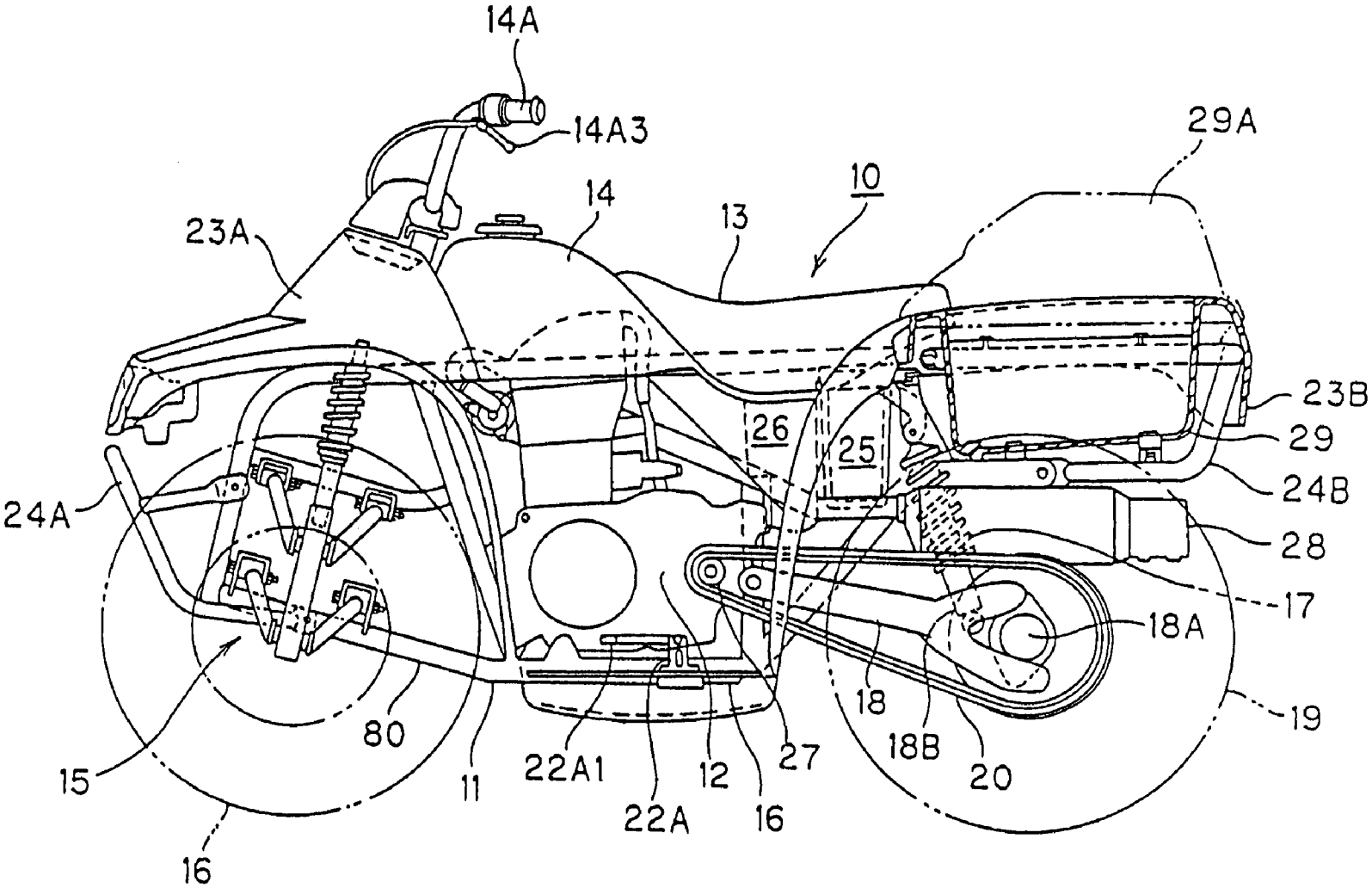
FIG. 1 is a side plan view of an ATV according to a selected illustrative embodiment of the present invention.

Referring now to the drawings, a selected illustrative embodiment of the present invention will be described. It should be understood that only structures considered necessary for clarifying the present invention are described herein. Other conventional structures, and those of ancillary and auxiliary components of the ATV, are assumed to be known and understood by those skilled in the art.

Referring now to FIGS. 1-4, an all terrain vehicle (ATV) is shown generally at 10, and is a four-wheel drive vehicle which is suitable for use in off-road and back country settings. The ATV 10 can be used in agriculture, forestry, cattle breeding, hunting, transportation for security monitoring, recreational and leisure use, as well as many other uses. The ATV 10 includes a vehicle frame 11. An engine 12 is supported at the center of the vehicle frame 11, a saddle-type seat 13 is supported above the engine 12, and a fuel tank 14 is supported above the engine and in front of the saddle-type seat 13. A bar-shaped handle 14A is supported on the frame in front of the fuel tank for steering a front wheel 16. The bar-shaped handle 14A is provided with an accelerator lever 14A1, a brake lever 14A2, and a clutch lever 14A3 mounted thereon.

Figure 2:
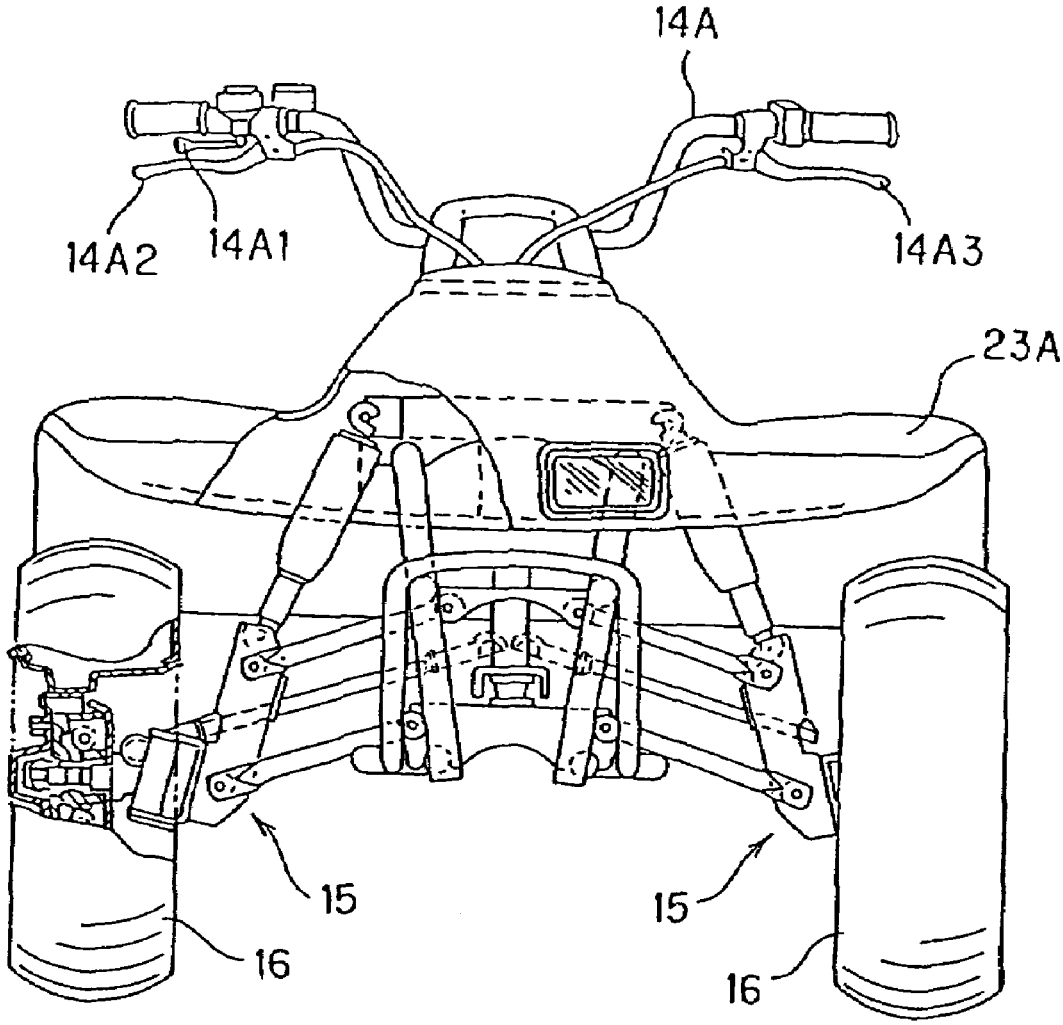
FIG. 2 is a front plan view of the ATV of FIG. 1.
Figure 4:
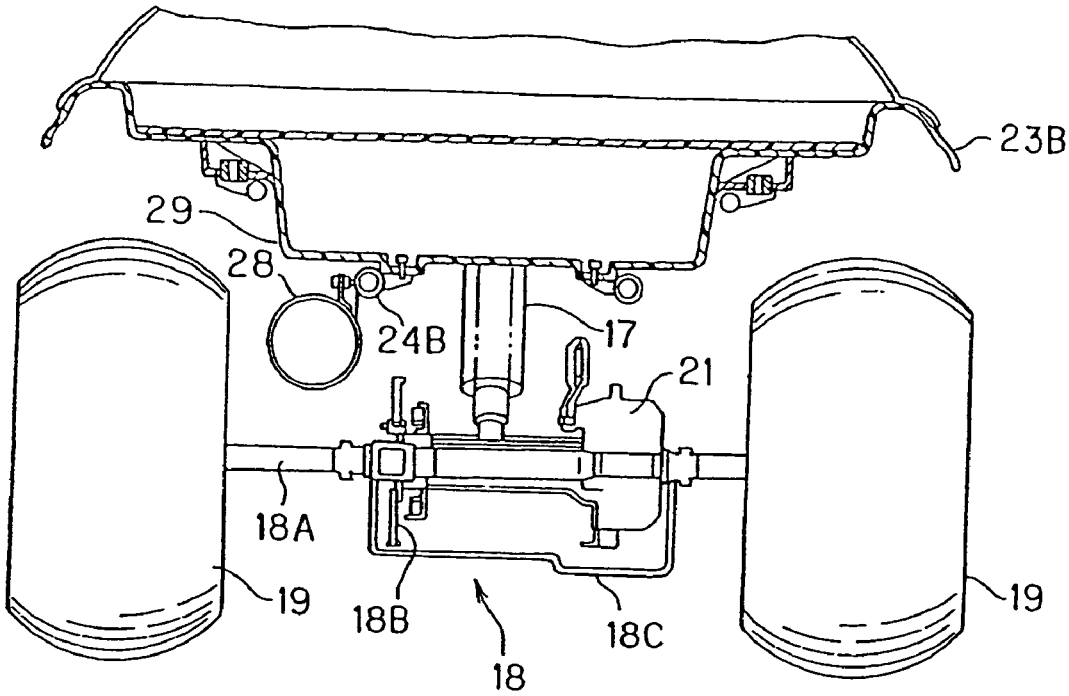
FIG. 4 is a rear plan view of the ATV of FIGS. 1-3.

As shown in FIG. 2, a pair of front wheels 16 are rotatably supported on the vehicle frame 11 via a pair of left and right suspension mechanisms 15, respectively. As shown in FIG. 4, a rear swing arm assembly 18 is supported at the rear center of the vehicle frame 11 via a suspension mechanism 17, and a pair of rear wheels 19 are respectively supported at opposite ends of a rear axle 18A of the rear swing arm assembly 18. A sprocket 18B is fixed to the rear axle 18A, and as shown in FIG. 1, a drive chain 20 is wound between the sprocket 18B and a final output shaft 27 of the engine 12. A brake mechanism 21 is also arranged on the rear axle 18A. The sprocket 18B and a guard member 18C for protecting the brake mechanism 21 are mounted to the rear swing arm assembly 18.

Figure 3:
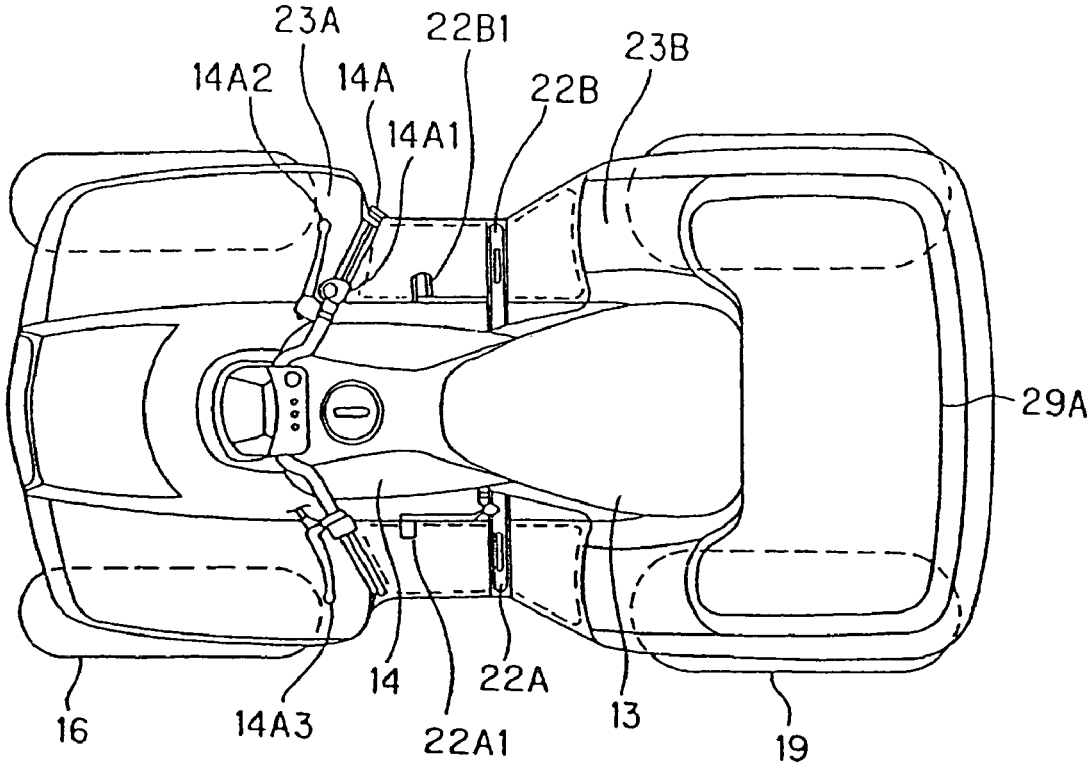
FIG. 3 is a top view of the ATV of FIGS. 1-2.

As shown in FIG. 3, footrests 22A, 22B for supporting the operator's feet are respectively disposed on the left and right sides of the vehicle frame 11. The footrests 22A, 22B are medially positioned between the front wheel 16 and the rear wheel 19. As shown in FIG. 1, one footrest 22A is provided with a change pedal 22A1, for switching the transmission ratio of a gear speed change mechanism, described later, and the change pedal 22A1 is mounted so as to be capable of pivotal movement. The other footrest 22B is provided with a brake pedal 22B1, for operating the brake mechanism 21 described above, and is also mounted so as to be capable of pivotal movement. In addition, as shown in FIG. 1 to FIG. 4, the vehicle frame 11 is provided with a front fender 23A for covering the front wheel 16, a rear fender 23B for covering the rear wheel 19, a front guard 24A, a rear guard 24B, a battery 25, an air cleaner 26, and other accessory components of the ATV mounted thereto. The rear guard 24B supports an exhaust muffler 28, and also supports a storage case 29 having an openable and closable lid 29A.

Figure 5:
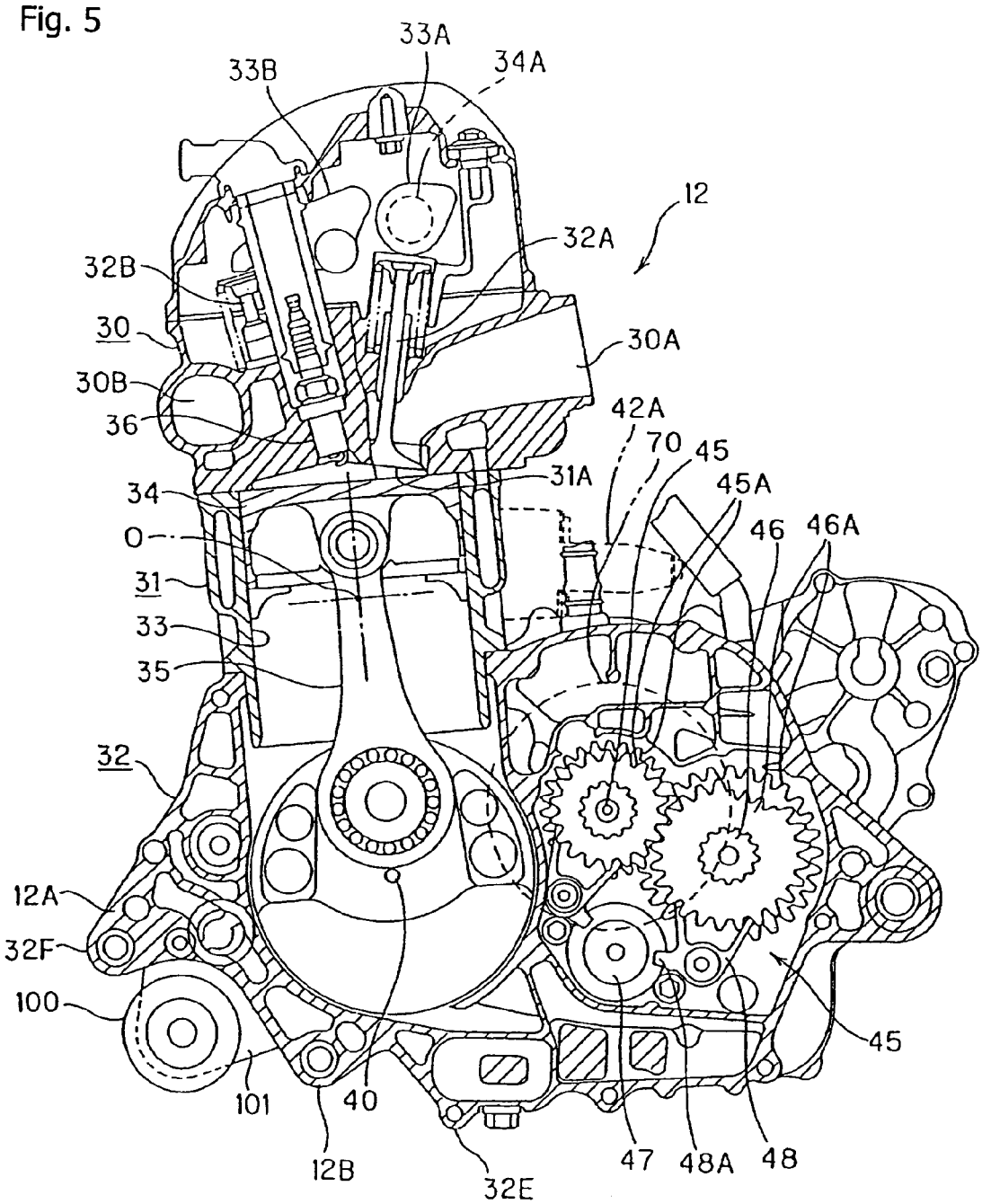
FIG. 5 is a cross-sectional view of an engine, which is a component of the ATV of FIGS. 1-4.

Referring now to FIGS. 5-8, the engine 12 will now be discussed. In the depicted embodiment, the engine 12 is a four-cycle engine, and includes a cylinder head 30, a cylinder block 31, and a crankcase 32, as shown in FIG. 5. The cylinder block 31 is formed with a cylinder 33, which is provided with a piston 34 capable of sliding reciprocal movement. The piston 34 is connected to a crankshaft 40 via a connecting rod 35, and the crankshaft 40 is supported by the crankcase 32.

The cylinder head 30 is provided with an air-intake channel 30A and an exhaust channel 30B, and the respective channels include an air-intake valve 32A and an exhaust valve 32B in corresponding fashion. These valve bodies are configured to be capable of opening and closing an air-intake port 31A and an exhaust port (not shown) in communication with the cylinder 33. The air-intake valve 32A moves in the vertical direction to open and close the air-intake port 31A, according to the profile of a cam 33A, while the exhaust valve 32B moves in the vertical direction to open and close the exhaust port (not shown) via a rocker arm 33B driven by the cam 33A.

Figure 6:
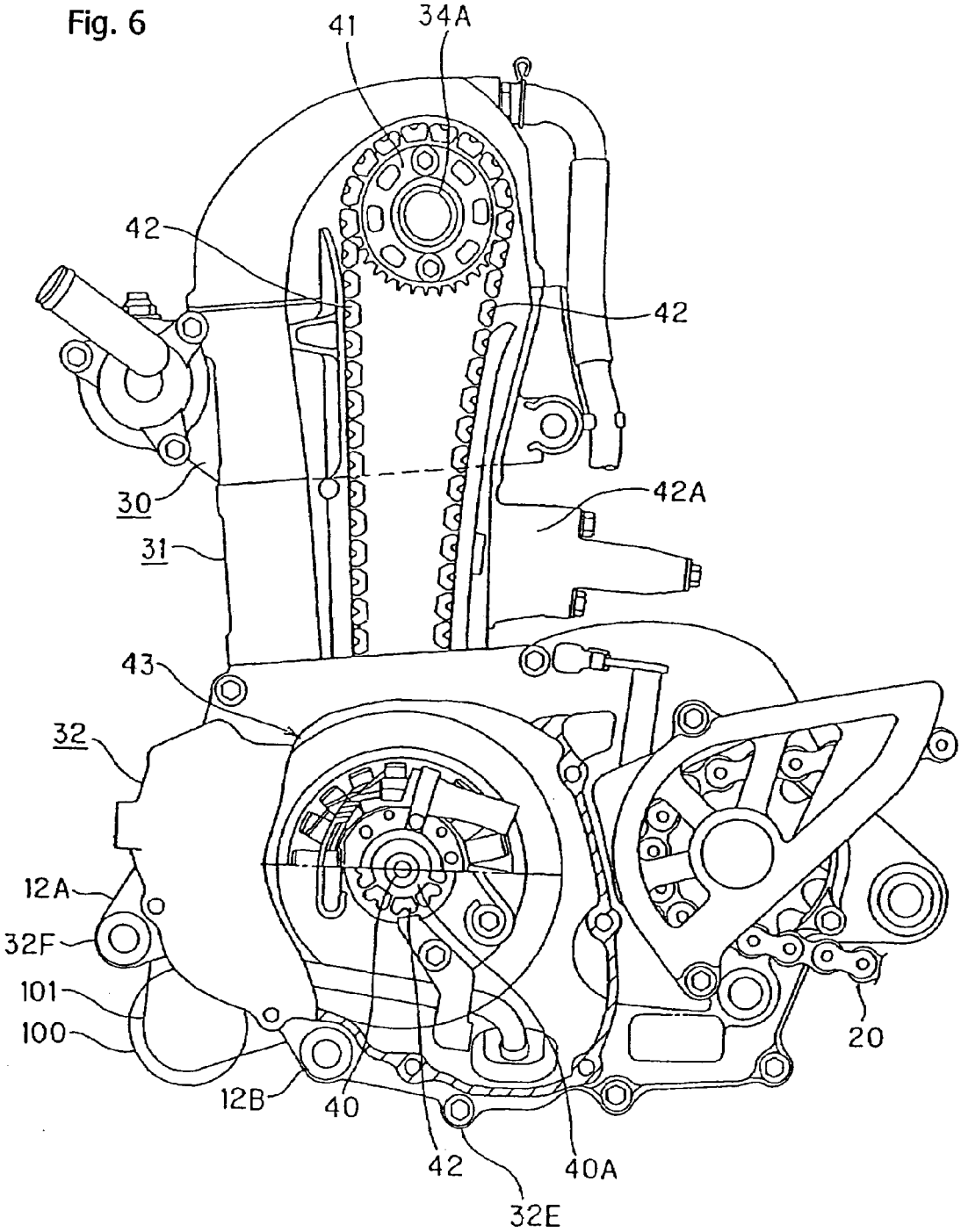
FIG. 6 is a side view of the engine of FIG. 5, shown partly in cross-section.

As shown in FIG. 6, a cam timing sprocket 41 is provided at the shaft end of a camshaft 34A which supports the cam 33A, and a timing chain 42 is wound between the cam timing sprocket 41 and a crank timing sprocket 40A fixed to the shaft end of the crankshaft 40. The timing chain 42 is provided with tension via a chain tensioner 42A.

The rotary force of the crankshaft 40 is transmitted to the camshaft 34A via the timing chain 42, whereby the cam 33A and the rocker arm 33B rotate or pivot causing the air-intake valve 32A and the exhaust valve 32B to move in the vertical direction, so that the air-intake and exhaust port are opened at a respective suitable timing, according to the rotation of the crankshaft 40.

As shown in FIG. 5, a spark plug 36 is disposed on the cylinder head 30, and a throttle body and a carburetor (not shown), are connected to the air-intake channel 30A. Combustion air is supplied via the throttle body and fuel is supplied via the carburetor, to be mixed with combustion air at a suitable mixture ratio. The air-fuel mixture is taken into the cylinder 33, and then ignited by the spark plug 36, whereby an explosive power generated by ignition forcibly moves the piston 34 in the downward vertical direction to rotate the crankshaft 40.

The shaft end of the crankshaft 40 is coaxially provided with an AC generator (ACG) 43, as shown in FIG. 6. The ACG 43 generates power according to the rotation of the crankshaft 40, and the power is used to charge a battery 204 and as a power source for assorted electric equipment such as an Electric Control Unit (ECU) 201, described later, of the vehicle 10 (see FIG. 9).

Figure 7:
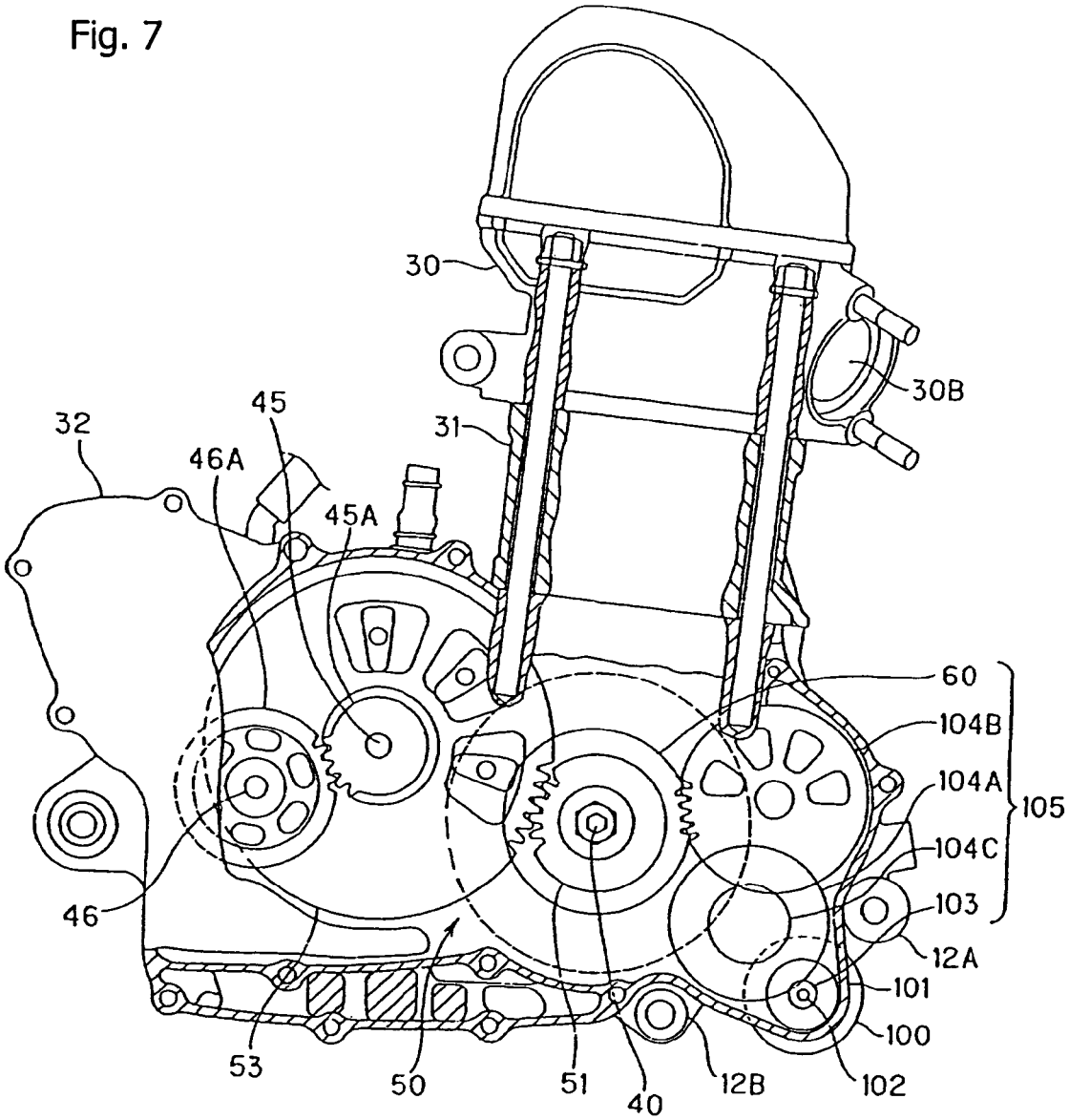
FIG. 7 is a side plan view of the engine of FIGS. 5-6, shown partly in cross-section.

Referring now to FIG. 7, it will be seen that in addition to the ACG 43, a start clutch 50, including a centrifugal clutch mechanism, and a starting gear 60 are coaxially disposed on the crankshaft 40. Although not shown in detail, the start clutch 50 includes an inner clutch member, connected to the crankshaft 40 and having at least one spring-loaded clutch shoe, and an outer clutch drum. The clutch drum is provided for moving concurrently with the inner clutch member, when driven by a frictional force generated when the clutch shoe of the inner clutch member is pressed thereon. When the crankshaft 40 rotates, the inner clutch member always rotates, because it is affixed to the crankshaft for concurrent movement therewith. When the inner clutch member is rotating at a low speed, such as during engine idling, in which the rotary speed of the crankshaft 40 is below a predetermined value, the clutch shoe does not come into contact with the outer clutch drum, and hence the inner clutch member runs idle, and the clutch is disengaged. On the other hand, when the rotary speed of the crankshaft 40 exceeds a predetermined value for a given time period, the clutch shoe of the inner clutch member, by its centrifugal force, is pressed against the outer clutch drum and, hence, the clutch is thereby engaged. The centrifugal clutch mechanism of the start clutch 50 may be similar, in many respects, to the centrifugal clutch disclosed in U.S. Pat. No. 4,687,085 or to the centrifugal clutch disclosed in U.S. Pat. No. 4,830,163, the complete disclosures of which are incorporated by reference herein.

A primary drive gear 51 is coaxially connected to the outer clutch drum of the start clutch 50, and when the centrifugal clutch is engaged, the rotary force of the crankshaft 40 is transmitted to the primary drive gear 51 via the start clutch 50.

A primary driven gear 53 engages the primary drive gear 51, and the primary driven gear 53 is disposed coaxially with a main transmission shaft 45, which constitutes part of a constant-mesh gear speed change device (transmission), described later.

In addition to the start clutch 50, and as shown in FIG. 5, the engine 12 also includes a speed-change clutch 70 having a number of frictional plates (not shown). The speed-change clutch 70 is disposed coaxially with the main transmission shaft 45.

The speed-change clutch 70 includes an outer clutch member which rotates integrally with the primary driven gear 53 (FIG. 7), an inner clutch member rotating integrally with the main transmission shaft 45, the plurality of frictional plates disposed between the inner and outer clutch members, and a clutch piston for pressing the frictional plates together. The clutch piston is operable to engage the speed-change clutch 70 by bringing the outer clutch member and the inner clutch member into press contact with each other, via the frictional plates.

In this arrangement, when the start clutch 50 is connected, the rotary force of the crankshaft 40 is transmitted to the primary drive gear 51, and then to the primary driven gear 53. The rotary force is then is transmitted to the outer clutch member of the speed-change clutch 70, which is connected integrally with the driven gear 53. In this state, if the speed-change clutch 70 is not engaged, the outer clutch member of the speed-change clutch 70 runs idle, and the rotary force thereof is not transmitted to the main transmission shaft 45. In contrast, when the start clutch 50 is engaged, and then the speed-change clutch 70 is engaged, the rotary force of the crankshaft 40 is operatively transmitted to the main transmission shaft 45, via the primary drive gear 51, the primary driven gear 53, and the speed-change clutch 70.

In addition to the crankshaft 40 and the main transmission shaft 45, a countershaft 46, a shift drum 47, and a shift fork 48 are supported in the crankcase 32, as shown in FIG. 5. These constitute the constant-mesh gear speed change device (transmission). The direction of travel and the transmission ratio are switchable among five forward gears and one reverse gear.

In other words, a plurality of gears 45A are mounted on the main transmission shaft 45, and a plurality of gears 46A are mounted on the countershaft 46, and the countershaft-mounted gears 46A engage the gears 45A of the main transmission shaft 45. Then, by selecting arbitrary gears 45A, 46A and engaging them with each other, transmission ratios corresponding to, for example, a first speed, a second speed or a third speed are defined, and the rotary force of the main transmission shaft 45, and hence speed, is changed by the gears 45A, 46A and transmitted to the countershaft 46 according to the defined transmission ratio. The rotary force is then transmitted to the final output shaft 27, connected to the countershaft 46 via the gear or the like, and then outputted and transmitted to the rear wheel 19 from the final output shaft 27 via the drive chain 20 as a driving power force of the engine 12, as shown in FIG. 1.

Although not shown, the gear speed change devices 45-48 are provided with a reverse movement speed change gear, and when the reverse movement is selected, the main transmission shaft 45 and the countershaft 46 are connected via the reverse movement speed change gear. In this arrangement, the rotary force transmitted to the main transmission shaft 45 via two clutch connections is shifted to the reverse movement gear, then transmitted to the final output shaft 27 (FIG. 1) via the countershaft 46, and then transmitted to the rear wheel 19 from the final output shaft 27 via the drive chain 20 as a power force of the engine 12.

Describing the forward movement speed change operation, connection of the speed-change clutch 70 is released by the operation of the clutch lever 14A3 mounted to the bar-shaped handle 14A, whereby power transmission to the main transmission shaft 45 is disconnected.

Then, while power transmission to the main transmission shaft 45 is disconnected, the change pedal 22A1 (FIG. 1) mounted to the footrest 22A is pivoted. The change pedal 22A1 is connected to the shift drum 47. When the change pedal 22A1 is pivoted, the shift drum 47 rotates, and the rotation moves a shift pin 48A engaged with a helical groove (not shown) of the shift drum 47 in the axial direction. The shift pin 48A is integral with the shift fork 48, and when the shift pin 48A moves in the axial direction, the shift fork 48 slides in the axial direction. The shift fork 48, then, moves any one of the gears 46A on the countershaft 46 in the axial direction, whereby the selected one gear 46A and any one of the gears 45A on the main transmission shaft 45 are engaged.

Figure 8:
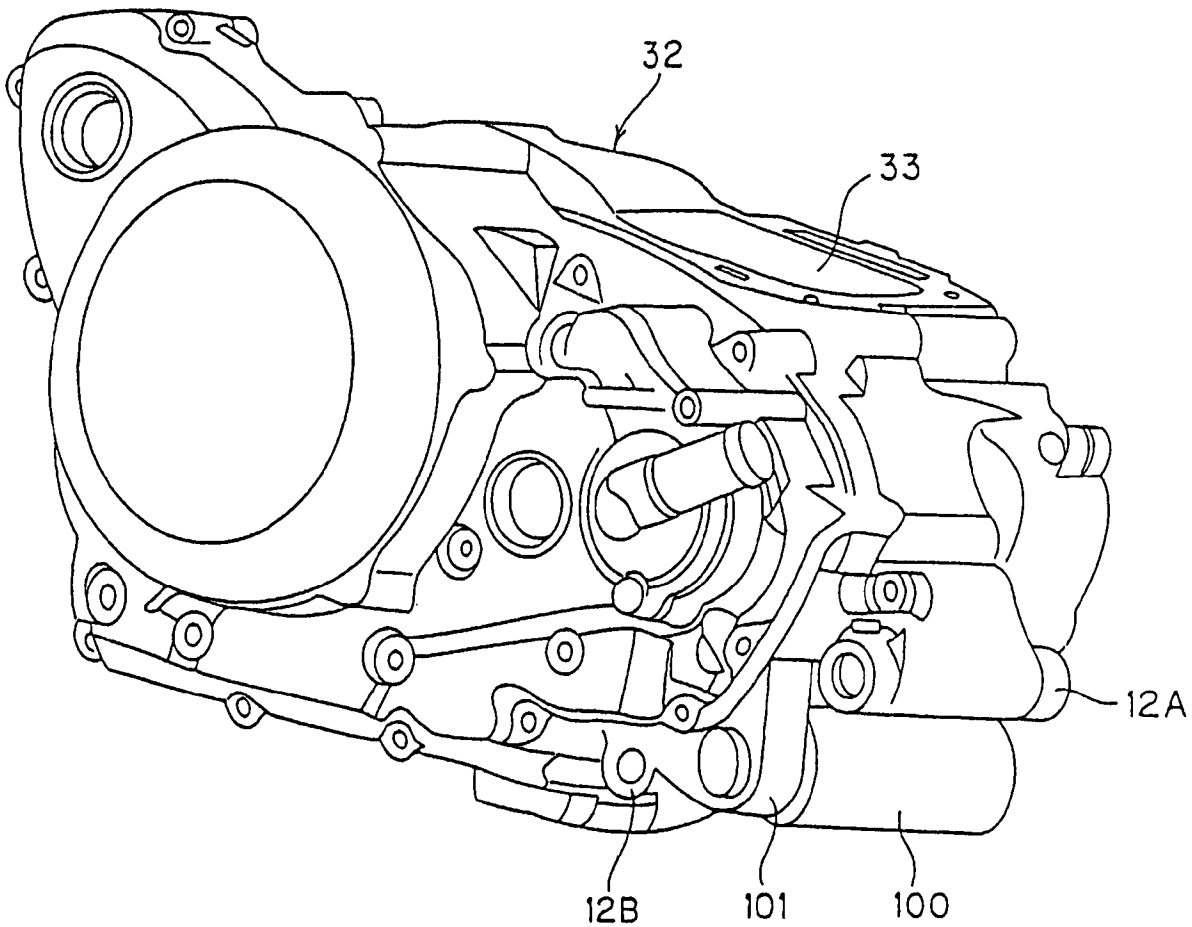
FIG. 8 is a perspective view of a crankcase which is a component part of the engine of FIGS. 5-7.

In this embodiment, as shown in FIGS. 5 to 7, the engine 12 is provided with a starter motor 100 for starting the engine. The engine 12 is also provided with the crankcase 32 as shown in FIG. 8, and the crankcase 32 is integrally molded with a starter support structure 101 formed therein, by casting at the front part thereof. The starter motor 100 is cantilevered by its attachment to the crankcase 32 at the starter support structure 101. The crankcase 32 includes a front engine mount 12A for fixing the front side of the engine 12 to the vehicle frame 11, and a lower engine mount 12B for fixing the lower side of the engine 12 to the vehicle frame 11. Both the engine mounts 12A, 12B are molded integrally as part of the crankcase 32 by casting. The starter support structure 101 is integrally molded in the crankcase casting between the front engine mount 12A and the lower engine mount 12B.

The starter support structure 101 is disposed at a position slightly shifted toward one side surface of the crankcase 32 in the area between the front engine mount 12A and the lower engine mount 12B, as shown, and is formed into a shape which projects obliquely forward.

The starter support structure 101 is, as shown in FIG. 7, is hollow, and a pinion gear 103 fixed to a motor shaft 102 of the starter motor 100 is disposed therein. A transmission gear 104A engages the pinion gear 103, and a transmission gear 104B engages a small gear 104C, which is integral with the transmission gear 104A. The transmission gear 104B also engages with the starting gear 60 connected to the crankshaft 40. The starting gear 60 is connected to the crankshaft 40 via a one-way clutch (not shown). The gear train described above constitutes a transmission mechanism 105 for transmitting a rotary force of the starter motor 100 to the crankshaft 40.

The one-way clutch (not shown) is a clutch that enables transmission of the rotary force of the starting gear 60 to the crankshaft 40, as long as the rotary speed of the starting gear 60 exceeds the rotary speed of the crankshaft 40 within the same time period. Instead of the one-way clutch, it is also possible to apply an electromagnetic pushing mechanism for moving the pinion gear 103 of the starter motor 100 between the position to mesh with the transmission gear 104A and the position not to mesh therewith using, for example, a magnet switch.

In this structure, when the starter motor 100 is started in the course of starting the engine 12, the pinion gear 103 rotates. Then the starting gear 60 rotates via the transmission gear 104A, the small gear 104C and the transmission gear 104B. Hence, the crankshaft 40, engaged with the starting gear 60 via the one-way clutch (not shown), is driven thereby. At this time, ignition control of the spark plug 36 is performed by the ECU, not shown, whereby the engine 12 is started.

When the engine 12 is started, the clutch connection of the start clutch 50 is released, and the power is not transmitted from the crankshaft 40 to the primary drive gear 51.

In other words, the engine 12 can be started according to the start command operation when connection between the crankshaft 40 and the speed-change clutch 70, and hence the constant-mesh gear speed change device (transmission), are disconnected with the start clutch 50 (centrifugal clutch).

Figure 9:
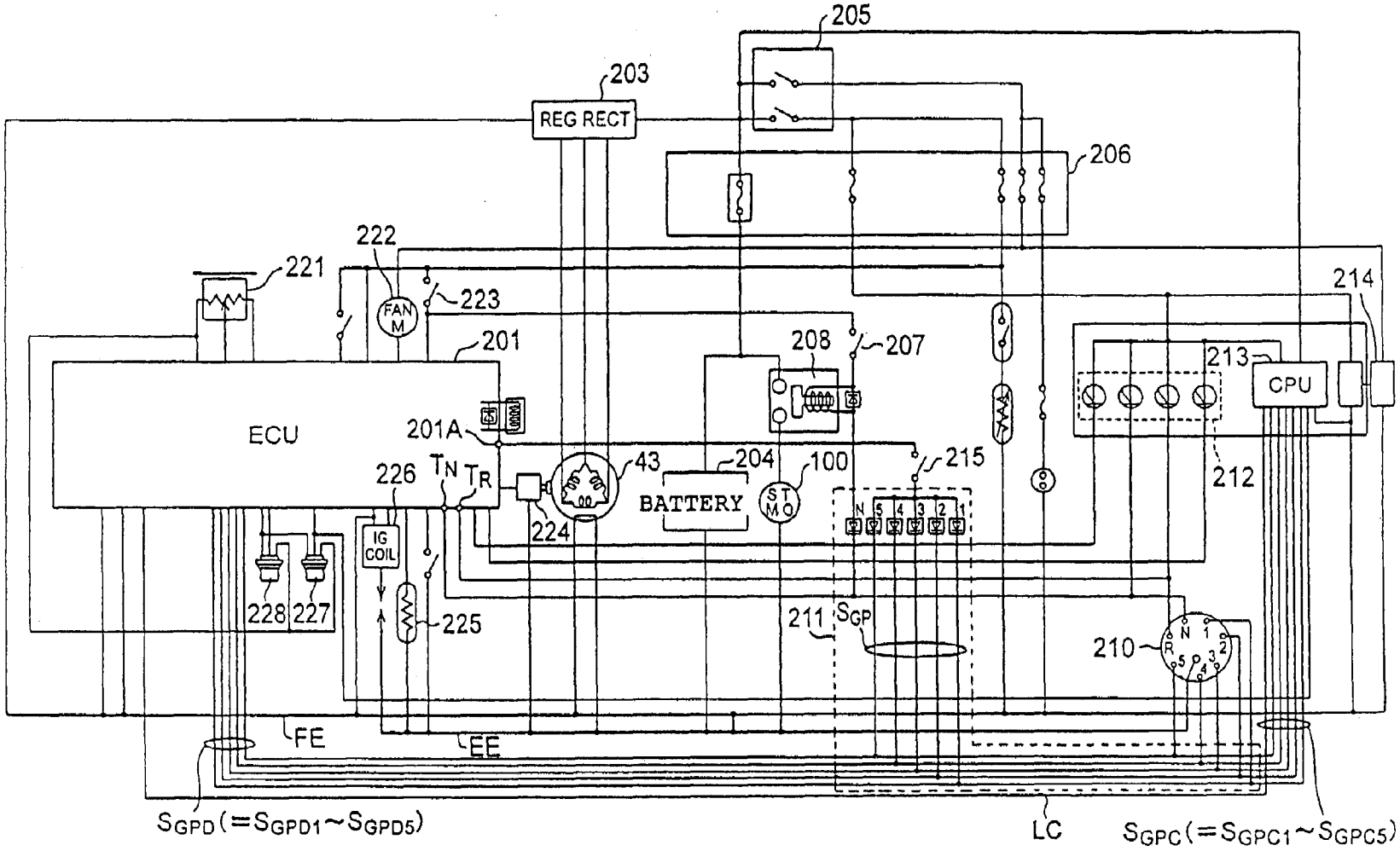
FIG. 9 is a circuit diagram showing an electric system of the ATV of FIGS. 1-4.

The electric system of the ATV 10, shown in FIG. 9, includes the ECU 201, the ACG 43, a regulator-rectifier 203, a battery, and an ignition key switch. The ECU 201 controls an ignition system of the engine or the like. The ACG 43 generates AC power associated with the rotation of the crankshaft 40. The regulator-rectifier 203, having a three-phase full-wave rectification bridge circuit and a stabilizing circuit, not shown, rectifies and stabilizes a generated output of the ACG 43. The battery 204 stores the DC power supplied from an ACG 43 via the regulator-rectifier 203 and supplies the DC power to the respective parts. Finally, the ignition key switch 205 having a plurality of contact points, supplies power, which is supplied via the regulator-rectifier 203 when closed (ON state) in conjunction with the key operation of the rider.

The electric system of the ATV 10 further includes a fuse box 206, the starter motor 100, a shift switch 210, a diode box 211, a condition display unit 212, a CPU 213, a lamp/horn unit 214, and a stopwatch 215. The Fuse box 206, provided with a plurality of fuses, prevents excess current from being supplied to the respective parts directly from the regulator-rectifier 203 or from the regulator-rectifier 203 via the ignition key switch 205.

The starter motor 100 is connected to the battery 204 when a start switch 207 is closed, which occurs due to the operation of the rider when starting the engine. Closing the start switch 207 drives the starter magnet switch 208, closing the starter magnet switch. This rotates the crankshaft 40, a shift switch 210 which is interlocked with the operation of the change pedal 22A1, and hence the position of the shift drum 47.

The diode box 211, which is provided with a plurality of reverse current blocking diodes, is interlocked with the shift switch 210, and generates a gear position detection signal S GP. The diode box 211 provides branching of the gear position detection signal S GP and outputs it as a gear position display signal S GPD and a gear position control signal S GPC (which is equivalent to the engine start control signal).

The condition display unit 212 is provided with a plurality of LEDs for displaying the various conditions. The CPU 213 controls the entire ATV 10. The lamp/horn unit 214 turns on and off various lamps such as a front lamp and as well as drives an alarm unit (horn) under control of the CPU 231. Lastly, the stop switch 215 is interlocked with the operation of the brake.

In the structure described above, the ECU 201 is connected to a throttle sensor 221 for detecting the throttle opening, a fan motor 222 for driving a radiator fan, a kill switch 223 for stopping the engine in case of emergency, a pulse generator 224 for generating pulses which corresponds to the reference ignition timing, a cooling water temperature sensor 225 for detecting the temperature of cooling water, an ignition coil 226 for generating a high voltage for igniting the engine, a rotor angle sensor 227 for detecting the rotor angle and hence the crank angle of the ACG 43, and a fuel sensor 228 for detecting the amount of fuel.

The shift switch 210 is a changeover switch including seven contact points and one movable section. The seven contact points correspond to a forward first gear, a forward second gear, a forward third gear, a forward fourth gear, a forward fifth gear, a reverse gear, and the neutral position, respectively.

The diode box 211 includes six diodes DN and D1-D5 that correspond to the gear positions; the neutral position, the forward first gear, the forward second gear, the forward third gear, the forward fourth gear, the forward fifth gear, respectively.

Here, the electric connections among the ECU 201, the seven contact points constituting the shift switch 210, the diodes constituting the diode box 211 and the CPU will be described in detail.

The ECU 201 includes a stop switch terminal 201A and is directly connected to the stop switch terminal 201A. The stop switch terminal 201A is connected to the stop switch 215 and serves as a current supply terminal for generating a gear position detection signal as well as an anode terminal of the diode DN. Anode terminals of the diodes D1-D5 are also commonly connected to the stop switch terminal 201A via the stop switch 215.

A cathode terminal of the diode DN is connected to a neutral detection terminal TN of the ECU 201 and a corresponding contact point of the shift switch 210. In the same manner, the cathode terminals of the diodes D1-D5 are connected to a gear position display input terminal of the ECU 201 and corresponding contact points of the shift switches 210. The respective cathode terminals of the diodes D1-D5 are connected to the CPU 213.

The contact point corresponding to the reverse movement, which constitutes the shift switch 210, is connected to a reverse movement detection terminal of the ECU 201. This contact point is also connected to the regulator-rectifier 203 via the LED that constitutes the condition display unit 212, the fuse box 206, and the ignition switch 205.

Connected between the CPU 213 and the ECU 201 is a control line LC, which is used by the CPU 213 for controlling the ECU 201.

In the description below, the output signals from the diodes D1-D5 constituting the diode box 211 are referred to as the gear position detection signal S GP for the sake of convenience. Also, the signal which is branched off from the gear position detection signal S GP in the diode box 211 and reaches the gear position display input terminal of the ECU 201 is referred to as the gear position display signal S GPD. Similarly, the signal which is branched off from the gear position detection signal S GP in the diode box 211 and reaches the CPU 213 is referred to as the gear position control signal S GPC.

Subsequently, the engine ignition control operation will be described.

When the kill switch 223 is in the closed state (ON state), the rider inserts the key, and then the ignition switch 205 is turned ON in association with the key operation.

When the rider operates the start switch 207 to the closed state (ON state) in this state, the starter magnet switch 208 is driven and closed, such that the starter motor 100 is connected to the battery 204.

Consequently, the starter motor 100 is driven, the pinion gear 103 rotates, the start gear 60 rotates via the transmission gear 104A, a small gear 104C and the transmission gear 104B. Then, the crankshaft 40, which is integral therewith, is rotated at a low rate of speed, such that a rotary speed of the crankshaft 40 within a given period of time is smaller than the number of idling revolutions. When the crankshaft 40 rotates at a low speed such as idling, in which the rotary speed in a given time period are below a predetermined value, the clutch shoe of the start clutch 50 does not come into contact with the outer clutch, and hence the inner clutch runs idle. In this state, the CPU 213 controls ignition.

The control of the CPU 213 will now be described in detail.

(1) When the Gear is at the Neutral Position.

When the shift drum 47 corresponds to the neutral position of the gear due to the operation of the change pedal 22A1 by the rider, the movable section constituting the shift switch 210 is electrically connected to the contact point corresponding to the neutral position (shown by N in the drawing) out of the seven contact points.

Consequently, the cathode terminal of the diode DN is connected to an engine earth (ground) EE and a frame earth (ground) FE having the same potential (which is equivalent to "L" level) via the corresponding contact point of the shift switch 210.

Therefore, a current is supplied from the stop switch terminal 201A of the ECU 201 to the diode DN, and the current flows through the engine earth (ground) EE and the frame earth (ground) FE, and hence the potential level at the cathode terminal of the diode DN becomes "L" level (which is equivalent to the potential level of the engine earth (ground) and the frame earth (ground) FE).

Accordingly, the neutral detection terminal TN of the ECU 201 also becomes "L" level, and the ECU 201 determines that the engine start conditions are satisfied without waiting for the control of the CPU 213.

Therefore, the ECU 201, which determines that the engine start conditions are satisfied, controls the ignition coil 226 based on the pulse corresponding to the reference ignition timing generated by the pulse generator 224, controls the crank angle corresponding to the output of the rotor angle sensor 227, and applies a high voltage for ignition to the spark plug 36 connected to the secondary side of the ignition coil 226.

Accordingly, discharge between a center electrode and a ground electrode of the spark plug 36 is affected, so that air-fuel mixture supplied to a cylinder via a carburetor, not shown, is ignited, thereby completing the engine start.

When the engine 12 is started, the rotary speed of the crankshaft 40 increases to the number of idling revolutions. The starting gear 60 is provided on the crankshaft 40 via a one-way clutch, and hence when the rotary speed of the starting gear 60 exceeds the rotary speed of the crankshaft 40, the starting gear 60 and the crankshaft 40 are connected. Similarly, when the rotary speed of the starting gear 60 is slower than the rotary speed of the crankshaft 40 within the period time, the starting gear 60 and the crankshaft 40 are disconnected, whereby the starting gear 60 runs idle. Therefore, even when the engine 12 is started, since the rotary speed of the starting gear 60 is slower than the rotary speed of the crankshaft 40, the starting gear 60 and the crankshaft 40 are disconnected after having started the engine. Therefore, when the starter motor 100 is driven after having started the engine, the respective gears 103, 104A, 104B, and 60 of the transmission mechanism 105 run idle.

When the engine 12 starts, the clutch connection of the start clutch 50 is released, and hence the power is not transmitted from the crankshaft 40 to the primary drive gear 51.

In other words, the start clutch 50 which serves as a centrifugal clutch, can start the engine in a state in which connection between the crankshaft 40 and the aforementioned speed-change clutch 70, and hence the connection with the aforementioned constant-mesh gear speed change device (transmission), is disconnected.

(2) When the Gear is at any one of the Forward First Gear to the Forward Fifth Gear.

When the shift drum 47 is under the condition corresponding to the forward first gear to the forward fifth gear of the gear by the operation of the change pedal 22A1 by the rider, the movable section which constitutes the shift switch 210 is electrically connected to the contact point which corresponds to any one of the forward first gear to the forward fifth gear (shown by 1 to 5 in the drawing) out of the seven contact points.

Consequently, the cathode terminals of the diodes DX (X=1–5) corresponding to the forward gear position are connected to the engine earth (ground) EE and the frame earth (ground) FE having the same potential via the corresponding contact points and the movable section of the shift switch 210.

Therefore, the current is supplied from the stop switch terminal 201A of the ECU 201 via the stop switch 215 to the diode DX, and the current flows to the engine earth (ground) EE and the frame earth (ground) FE, and hence the potential level of the cathode terminal of the diode DX becomes "L" level (which is equivalent to the potential level of the engine earth (ground) and the frame earth (ground) FE). In other words, gear position detection signals S GPX (X=1–5) corresponding to the forward gear positions are at "L" level, and gear position display signals S GPDX (X=1–5) and gear position control signals S GPCX (X=1–5) branched off therefrom are also at "L" level.

At this time, since the cathode terminals of the diodes DY (Y=1–5, and $Y^1X$) which correspond to the unselected forward gear positions are not connected to the engine earth (ground) EE and the frame earth (ground) FE, the corresponding gear position detection signals S GPY (Y=1–5, and $Y^1X$) become "H" level (which is equivalent to the potential level of the stop switch terminal 201A of the ECU 201, more precisely, the potential level of the stop switch terminal 201A in which the amount of voltage drop of the diode is taken into account), and hence gear position display signals S GPDY (Y=1–5, and $Y^1X$) and gear position control signals S GPCY (Y=1–5 and $Y^1X$) branched off therefrom, are also at "H" level.

More specifically, when the shift drum 47 is in a position corresponding to a forward third gear position by the operation of the change pedal 22A1, a gear position detection signal S GP3 becomes "L" level. In this state, a gear position display signal S GPD3 and a gear position control signal S GPC3 branched off therefrom, are also at the "L" level. On the other hand, gear position detection signals S GP1, S GP2, S GP4, S GP5 are at "H" level, and gear position display signals S GPD1, S GPD2, S GPD4, S GPD5 which are branched off and outputted to the ECU 201 are at "H level as well as gear position control signals S GPC1, S GPC2, S GPC4, S GPC5 which are outputted to the CPU 213.

Consequently, when only one of the gear position control signals S GPCX (X=1–5) becomes "L" level, it is determined that the gear position is the forward gear position, and the brake is being applied, and hence an instruction to permit ignition is sent to the ECU 201 via the control line LC.

Accordingly, the ECU 201 controls the ignition coil 226, based on both the pulse corresponding to the reference ignition timing generated by the pulse generator 224 and on the crank angle corresponding to the output of the rotor angle sensor 227. The ECU 201 also applies a high voltage for ignition to the spark plug 36 connected to the secondary side of the ignition coil 226.

Accordingly, discharge between the center electrode and the earth (ground) electrode of the spark plug 36 is effected, and air-fuel mixture supplied into the cylinder via a carburetor, not shown, is ignited, thereby completing the engine start.

When the engine 12 starts, the rotary speed of the crankshaft 40 increases to the number of idling revolutions. The starting gear 60 is provided on the crankshaft 40 via the one-way clutch, and hence when the rotary speed of the starting gear 60 exceeds the rotary speed of the crankshaft 40, the starting gear 60 and the crankshaft 40 are connected. Similarly, when the rotary speed of the starting gear 60 is less than the rotary speed of the crankshaft 40, the starting gear 60 and the crankshaft 40 are disconnected and the starting gear 60 runs idle. Therefore, even when the engine 12 starts, since the rotary speed of the starting gear 60 is less than the rotary speed of the crankshaft 40, the starting gear 60 and the crankshaft 40 are disconnected after having started the engine. Therefore, when the starter motor 100 is driven after having started the engine, the respective gears 103, 104A, 104B, 60 of the transmission mechanism 105 run idle.

When the engine 12 starts, the clutch connection of the start clutch 50 is released, and the power is not transmitted from the crankshaft 40 to the primary drive gear 51.

This means the start clutch 50, which functions as a centrifugal clutch, can start the engine in a state in which the crankshaft 40 and the aforementioned speed-change clutch 70, and hence the aforementioned constant-mesh gear speed change device (transmission), are disconnected.

In other words, when the gear position is at the forward gear position and the brake is operated to close the stop switch (ON state), the engine can be started immediately. Therefore, even when the engine is stopped while climbing the uphill, the vehicle can be started again easily and quickly without sudden acceleration.

On the other hand, since only the gear position display signal S GPD3 out of the input gear position display signals S GPD is at the "L" level, the ECU 201 turns on a gear position display lamp, which corresponds to the forward third gear, not shown, to notify the rider that the gear is now at the forward third gear position.

In contrast to the above-described operation, when all the gear position control signals S GPCX (X=1–5) are in the high-impedance state, the CPU 213 determines that the stop switch 215 is open (OFF state) and the brake is not applied. The CPU 213, therefore, sends an instruction to prohibit ignition, except for the case where the gear is at the neutral position, to the ECU 201 via the control line LC.

When all the gear position control signals S GPCX (X=1–5) are at the "H" level, the CPU 213 determines that the brake is operated, but the gear is not at the forward gear position.

(3) When the Gear is at the Reverse Position.

When the shift drum 47 is in a position corresponding to the reverse position of the gear by the operation of the change pedal 22A1 of the rider, the movable section which constitutes the shift switch 210 is electrically connected to the contact point which corresponds to the reverse position (represented by R in the drawing) out of the seven contact points.

Consequently, a reverse movement detection terminal TR of the ECU 201 is connected to the engine earth (ground) EE and the frame earth (ground) FE via the shift switch 210, and the potential level of the reverse movement detection terminal TR becomes "L" level (which is equivalent to the potential level of the engine earth (ground) and the frame earth (ground) FE).

Therefore, the ECU 201 determines that the engine start conditions are not satisfied without waiting for the control of the CPU 213, and goes into a waiting state, in which the ignition is prohibited.

As described thus far, according to this embodiment, when the engine stops, the engine can easily and quickly be started, when the crankshaft and the transmission are disconnected by the centrifugal clutch, when the gear is at one of the neutral position and the forward gear position (in the example described above, the forward first to fifth gears).

Although a description has been made regarding the speed change device having five forward gears and one reverse gear thus far, the invention is not limited thereto, and the speed change device having the arbitrary number of gears is applicable.

Although a description has been made regarding the case in which the gear is at the position corresponding to the case where the gear position detection signal S GP, the gear position display signal S GPD, and the gear position control signal S GPC are at "L" level, the invention is not limited thereto, and the circuit can be configured to cause the gear to be at the position corresponding to the case in which the gear position detection signal S GP, the gear position display signal S GPD, and the gear position control signal S GPC are at "H" level.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

Having thus described the invention, what is claimed is:

1. A starter apparatus for an all-terrain vehicle comprising an engine having a crankshaft and a transmission, wherein the vehicle also comprises an ignition switch operatively connected to the engine, said starter apparatus comprising:

a centrifugal clutch capable of engaging when the rotary speed of the crankshaft reaches a predetermined threshold value, wherein the centrifugal clutch operatively connects the crankshaft to the transmission when engaged, to transmit a rotary force of the crankshaft to the transmission;

a gear position sensor connected to the transmission for detecting a gear position thereof;

a starter operatively connected to the crankshaft; and a controller which is operable to enable starting of the engine, according to a start command operation, when the centrifugal clutch is disengaged and the detected gear position is a neutral or a forward gear position;

wherein the centrifugal clutch comprises:

an inner clutch member which is attached to the crankshaft for concurrent rotation therewith, and an outer clutch drum which is operatively connected to the transmission, wherein the centrifugal clutch is disengaged when the crankshaft turns at a speed below the predetermined threshold value;

whereby, when the engine is started with the transmission engaged in a forward gear, the initial rotary speed of the crankshaft will be below the threshold value, resulting in the centrifugal clutch being disengaged.

2. The starter apparatus for an all-terrain vehicle according to claim 1, wherein the controller is operable to start the engine according to the start command operation when the gear position is a forward gear position, a brake is engaged, and a stop switch is closed.

3. The starter apparatus for an all-terrain vehicle according to claim 1, wherein the controller is operable to disable engine starting when the gear position detected by the gear position sensor is a reverse gear position.

4. The starter apparatus for an all-terrain vehicle according to claim 1, wherein the gear position sensor comprises:

a shift switch having a plurality of contact points opened and closed according to the gear position of the transmission, and a diode box comprising a plurality of diodes which are electrically connected to the contact points, wherein the diode box is operable, in cooperation with the shift switch, to produce a gear position detection signal, the diode box further being operable to branch said gear position detection signal into an engine start control signal and a gear position display signal.

5. The starter apparatus for an all-terrain vehicle according to claim 4, wherein the engine start control signal is usable by the controller, along with data from the gear position sensor, to determine whether to permit or prohibit starting of the engine.

6. The starter apparatus for an all-terrain vehicle according to claim 4, wherein the gear position display signal is operatively connected to a gear position display lamp which is operable to generate a display corresponding to a detected transmission gear position.

7. An engine, comprising:

a crankshaft;

a transmission;

a gear position sensor for detecting a gear position of the transmission;

a centrifugal clutch, comprising:

an inner clutch member which is attached to the crankshaft for concurrent rotation therewith, and an outer clutch drum which is operatively connected to the transmission, the centrifugal clutch being capable of engaging when the rotary speed of the crankshaft reaches a predetermined threshold value, wherein the centrifugal clutch operatively connects the crankshaft to the transmission when engaged, to transmit a rotary force of the crankshaft to the transmission;

wherein the centrifugal clutch is disengaged when the crankshaft turns at a speed below the predetermined threshold value;

a starter operatively connected to the crankshaft; and a controller which is operable to enable starting of the engine, according to a start command operation, when the centrifugal clutch is disengaged and when the sensed gear position is a gear position other than reverse;

whereby, when the engine is started with the transmission engaged in a forward gear, the initial rotary speed of the crankshaft will be below the threshold value, resulting in the centrifugal clutch being disengaged.

8. The engine according to claim 7, wherein the controller is adapted to prohibit engine starting when the gear position detected by the gear position sensor is the reverse gear position.

9. The engine according to claim 7, wherein the gear position sensor comprises:

a shift switch having a plurality of contact points opened and closed according to the gear position of the transmission and a diode box having a plurality of diodes which are electrically connected to the contact points and, in cooperation with the shift switch, produces a gear position detection signal, the diode box causing a gear position detection signal to branch into an engine staff control signal and a gear position display signal.

10. An all-terrain vehicle, comprising:

a frame;

an engine supported on the frame and comprising a crankshaft and a transmission;

an ignition switch operatively connected to the engine, such that the engine is capable of being started in response to operation of the ignition switch, a starter apparatus comprising:

a centrifugal clutch for transmitting a rotary force of the crankshaft to the transmission when the rotary speed of the crankshaft reaches a predetermined threshold value;

a gear position sensor for detecting a gear position of the transmission;

a starter operatively connected to the cranikshaft; and a controller which enables starting of the engine according to a start command operation when the crankshaft and the transmission are disconnected by the centrifugal clutch and when the gear position is at one of a neutral position and a forward gear position based on the gear position detected by the gear position sensor wherein the centrifugal clutch comprises:

an inner clutch member which is attached to the crankshaft for concurrent rotation therewith, and an outer clutch drum which is operatively connected to the transmission, wherein the centrifugal clutch is disengaged when the crankshaft turns at a speed below the predetermined threshold value;

whereby, when the engine is startfed with the transmission engaged in a forward gear, the initial rotary speed of the crankshaft will be below the threshold value, resulting in the centrifugal clutch being disengaged.

11. The all-terrain vehicle according to claim 10, wherein the controller is adapted to start the engine according to the start command operation when the gear position is the forward gear position, a brake is operated, and a stop switch is closed.

12. The all-terrain vehicle according to claim 10, wherein the controller is adapted to prohibit the engine start when the gear position detected by the gear position sensor is the reverse gear position.

13. The all-terrain vehicle according to claim 10, wherein the gear position sensor comprises:

a shift switch having a plurality of contact points opened and closed according to the gear position of the transmission and a diode box having a plurality of diodes which are electrically connected to the contact points and, in cooperation with the shift switch, produces a gear position detection signal, the diode box causing a gear position detection signal to branch into an engine start control signal and a gear position display signal.

14. A method of starting an engine of an all-terrain vehicle with a transmission thereof engaged in a forward gear, comprising the steps of:

operatively rotating a crankshaft of the all-terrain vehicle by rotating a pinion gear of a staffer, where the pinion gear is operatively connected to the crankshaft;

providing a timed spark to the engine at a time when a piston of the engine has compressed a fuel-air mixture in a combustion chamber thereof;

wherein the crankshaft is operatively disengaged from the transmission during the staffing of the engine by a centrifugal clutch disposed therebetween, wherein the centrifugal clutch comprises:

an inner clutch member which is attached to the crankshaft for concurrent rotation therewith, and an outer clutch drum which is operatively connected to the transmission, wherein the centrifugal clutch is disengaged when the crankshaft turns at a speed below a predetermined threshold value;

whereby, when the engine is started with the transmission engaged in a forward gear, the initial rotary speed of the crankshaft will be below the threshold value, resulting in the centrifugal clutch being disengaged.

15. The method of claim 14, further comprising a step of engaging the centrifugal clutch, and thereby operatively connecting the crankshaft to the transmission, when the rotary speed of the crankshaft reaches the predetermined threshold value.

* * * * *